US006793551B1

(12) United States Patent
Rehkemper et al.

(10) Patent No.: US 6,793,551 B1
(45) Date of Patent: Sep. 21, 2004

(54) DOLL WITH EXTERNALLY ACTUATED FUNCTIONS

(75) Inventors: Steven Rehkemper, Chicago, IL (US); Amparo Zacarias, Cicero, IL (US)

(73) Assignee: Rehco, LLC, Chicago, IL (US)

( * ) Notice: Subject to any disclaimer, the term of this patent is extended or adjusted under 35 U.S.C. 154(b) by 0 days.

(21) Appl. No.: 10/679,653

(22) Filed: Oct. 7, 2003

(51) Int. Cl.[7] ..... A63H 3/24
(52) U.S. Cl. ..... 446/130; 446/305
(58) Field of Search ..... 446/130, 305, 446/267, 246; 434/247, 262

(56) References Cited

U.S. PATENT DOCUMENTS 3,490,170 A * 1/1970 Wolf ..... 446/192
3,775,901 A * 12/1973 Ellman et al. ..... 446/134
4,160,338 A * 7/1979 Lyons et al. ..... 446/184
5,890,907 A * 4/1999 Minasian ..... 434/247
5,941,750 A * 8/1999 Pracas ..... 446/130

* cited by examiner

*Primary Examiner*—Jacob K. Ackun, Jr.

(57) ABSTRACT

A doll in combination with a toy toilet the doll having a reservoir contained within the torso that can be filled with liquid through a mouth. The reservoir is in communication with a nozzle having an orifice which is sealable with a magnetic valve assembly. The magnetic valve assembly is defined by a hollow valve housing with a top portion secured to the bottom section of the reservoir, a central opening in the top portion, and longitudinal grooves on the inside surface of the housing. A magnetic piston is slidably received within the valve housing, however, the longitudinal grooves permit liquid within the reservoir to travel past the magnetic piston. A valve ball is secured to the magnetic piston, and a spring positioned within the valve housing biases the magnetic piston out of the valve housing such that the valve ball creates a fluid tight seal against the nozzle sealing the orifice, preventing liquid from exiting the doll. The toy toilet includes an opening positioned under the seat and a piece of stretched material covering the opening that creates a sound when liquid falls onto the material, and a repelling magnet to repel the magnetic piston out of position, temporarily breaking the fluid tight seal such that liquid within the reservoir is able to travel through the orifice and discharge from the doll onto the stretched material creating simulated sounds.

12 Claims, 5 Drawing Sheets

DOLL WITH EXTERNALLY ACTUATED FUNCTIONS

FIELD OF THE INVENTION

The present invention is related to dolls and more particularly to dolls with magnetically activated functions that are externally activated.

BACKGROUND OF THE INVENTION

Dolls have always been the mainstay as a toy for young children. There have been numerous varieties of dolls from no interaction to fully interactive dolls. There exist dolls that speak, cry, sing and laugh in response to a child touching or squeezing various parts of the doll, as well as dolls that walk and crawl. Included with these features is the simulation of physiological functions such as the intake and elimination of liquids through the dolls body. While even these basic features are not new to the art, as there exists a plurality of dolls that can be fed liquid through a bottle and which also wet themselves as a result, however, the attractiveness of these dolls are diminished because the interest and involvement of the child is minimal. In order to increase the valve of such toys, some toys have made the elimination of the liquids delayed until the child completes a subsequent action.

One such doll is described in U.S. Pat. No. 3,775,901 which includes a doll that has an internal reservoir to hold a liquid that is fed through an orifice in the mouth of the doll. The reservoir further includes a discharge valve whose opening is effected by the close proximity of a permanent magnet. The permanent magnet being placed in a training seat with a chamber to hold the discharged liquid. Upon placing the doll on the training seat, the permanent magnet in the training seat attracts a magnet attached to the discharge valve pulling the discharge valve open allowing the liquid in the reservoir to discharge through a second orifice in its lower extremity. When the doll is removed from the training seat the attraction between the magnets is broken and the discharge valve closes.

Another such doll is described in U.S. Pat. No. 5,941,750 which also includes a reservoir for holding a liquid. The doll retains the liquid until some time after it is placed on a cot. The cot includes a magnetic field generating means that moves between an first and second position, which alternately opens and closes a valve in the doll. The opening of the valve in the doll permits the liquid in the reservoir to discharge, providing the doll with the means of wet itself in bed.

The continual need for improvements of the above prior art, provides for structural arrangements which may not have been very effective in their intended purposes. One such improvement over the prior art is sound effects and the ability to provide for more realistic sounds that would accompany the doll during the discharge of the liquid. Typically the prior art uses pre-recorded sound effects that accompany the doll and are programmed to play back at a specified time, only to indicate that the discharge of liquid has been completed and that the doll needs to be changed (see, U.S. Pat No. 5,941,750). The prior art seems to lack proper sound effects to indicate that the doll is currently discharging liquid. As such it is an object of the invention to also provide a toy toilet that is capable of emitting realistic sound effects that indicates that the doll is discharging liquid.

SUMMARY OF THE INVENTION

The present invention includes a doll having a head and a torso in combination with a toy toilet. The doll includes a reservoir contained within the torso that can be filled with liquid through a mouth defined by the head of the doll. The reservoir is in communication with a nozzle having an orifice which is sealable with a magnetic valve assembly. The magnetic valve assembly has (1) a hollow valve housing with a top portion secured to the bottom section of the reservoir, (2) a central opening in said top portion, and (3) at least one inside wall with a longitudinal groove. A magnetic piston is slidably received within the valve housing. The longitudinal groove, however, permits liquid within the reservoir to travel past the magnetic piston. A valve ball is secured to the magnetic piston, and a spring positioned within the valve housing biases the magnetic piston out of the bottom section of the reservoir such that the valve ball creates a fluid tight seal against the nozzle. Thereby sealing the orifice, such that liquid is prevented from exiting the nozzle.

The toy toilet includes a repelling magnet to exert a repelling magnetic field to the magnetic piston to force the magnetic piston upwardly against the spring such that the fluid tight seal between the valve ball and the nozzle is temporarily broken to permit liquid within the reservoir to travel through the second orifice and discharge from the doll. The toy toilet also includes a frame, a seat, a basin, an opening positioned under the seat and a piece of stretched material covering said opening that creates a sound when liquid falls onto said material. Whereby when the doll is placed on the seat the liquid in the reservoir discharges, falls onto the stretched material creating realistic sounds, and collected in the basin.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE DRAWINGS

Figure 1:
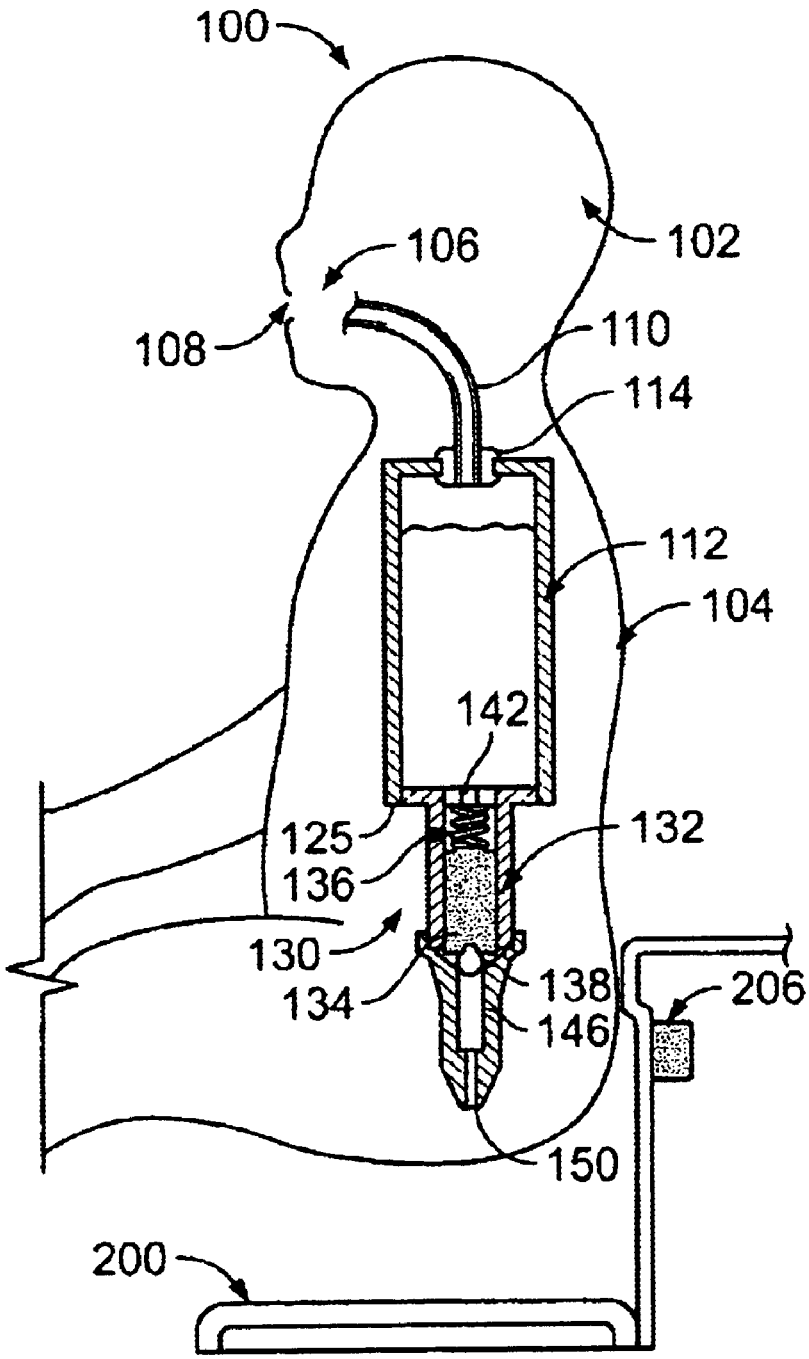
FIG. 1 is a side view illustrating a doll in combination with a toy toilet in accordance with the present invention.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

Referring now to FIG. 1, a doll 100 is shown with a toy toilet 200 (or any other type of toilet device or vessel). The doll 100 and toy toilet 200 are used in combination to simulate physiological human features such as going to the bathroom. The doll 100 which is capable of internally holding liquids when not on the toy toilet 200, will release or discharge the liquids when properly placed on the toy toilet 200. The invention will now be disclosed in greater detail with reference made to FIGS. 1 through 3.

The doll 100 includes a head 102 and torso 104. While the doll 100 is illustrated in its basic form, other appendages and features may be included to provide the doll 100 with more human characteristics. The head 102 further includes a first orifice 106 about a mouth 108. The first orifice 106 leads to a tube 110 that extends through the torso 104 to empty into a reservoir 112. The tube 110 is attached to the reservoir 112 with a seal 114 positioned between the two to prevent liquids from leaking. The reservoir 112 is capable of holding liquids that are fed through the first orifice 106.

Figure 2:
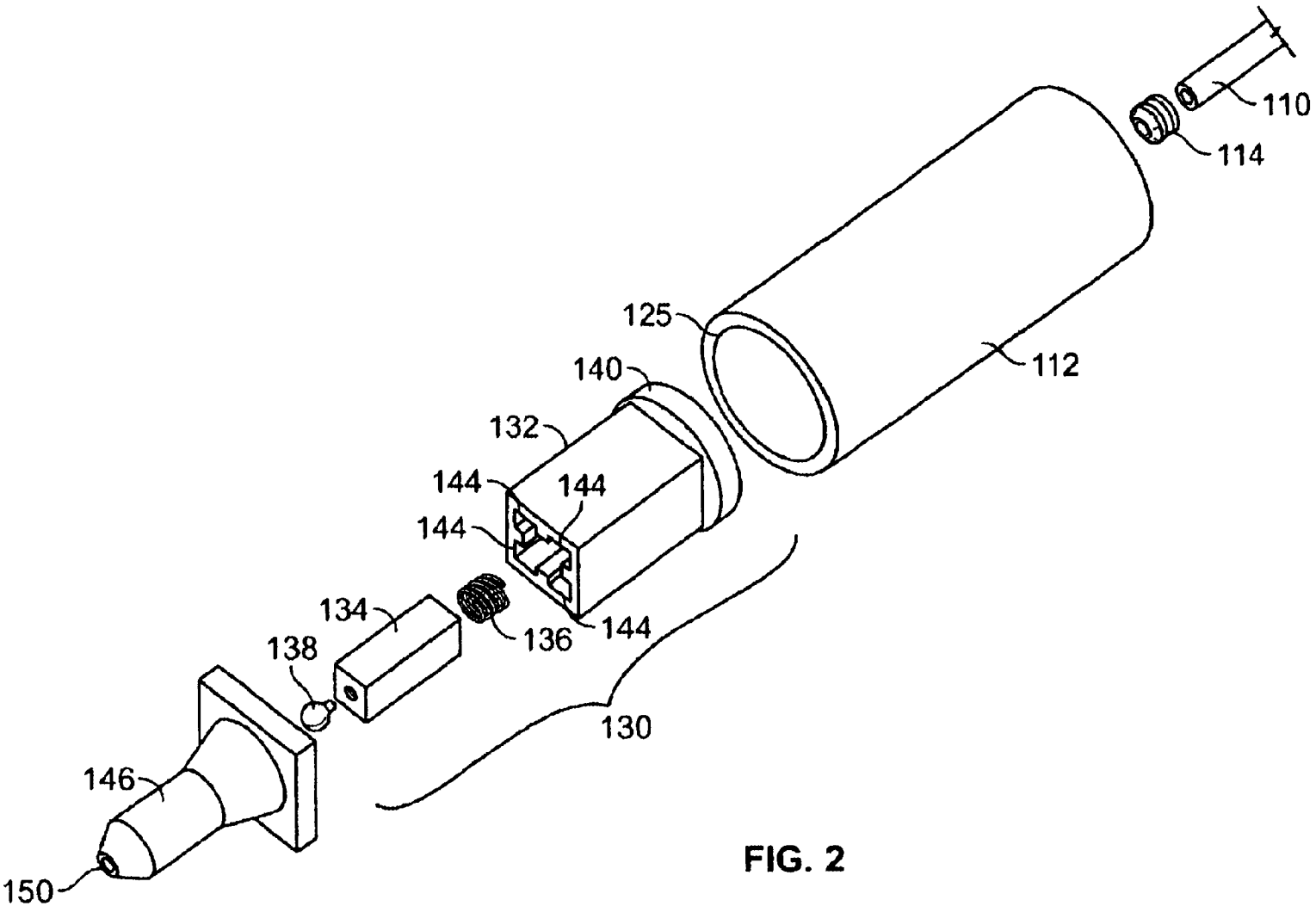
FIG. 2 is a perspective view of the magnetic valve assembly and the reservoir that is placed in the doll.

A magnetic valve assembly 130 is positioned in the bottom portion 125 of the reservoir 112 to control the discharge of liquids. The magnetic valve assembly 130 (best illustrated in FIG. 2) includes a valve housing 132, a magnetic piston 134, a piston return spring 136, and a ball valve 138. The valve housing 132 includes a top portion 140 with a central opening 142 (FIG. 1) and longitudinal grooves 144 (FIG. 2). The magnetic piston 134 is slidably positioned within the valve housing 132 with the piston return spring 136 being positioned between the magnetic piston 134 and the central opening 142 in the valve housing 132. The end of the magnetic piston 134 includes the ball valve 138 that is capable of sealing against the inside of converging nozzle 146. With this configuration, liquid in the reservoir is permitted to flow into the valve housing 132 via the central opening 142 and travel along the grooves 144 around the magnetic piston 134. The piston return spring 136 normally keeps the magnetic piston 134 towards the nozzle 146 such that the ball valve 138 seals against the inside walls of the converging nozzle 146, preventing liquid in the valve housing 132 and thus the reservoir 112 from exiting the nozzle 146. The nozzle 146 contains a second orifice 150 that is positioned in the lower extremity of the doll 100.

Figure 3:
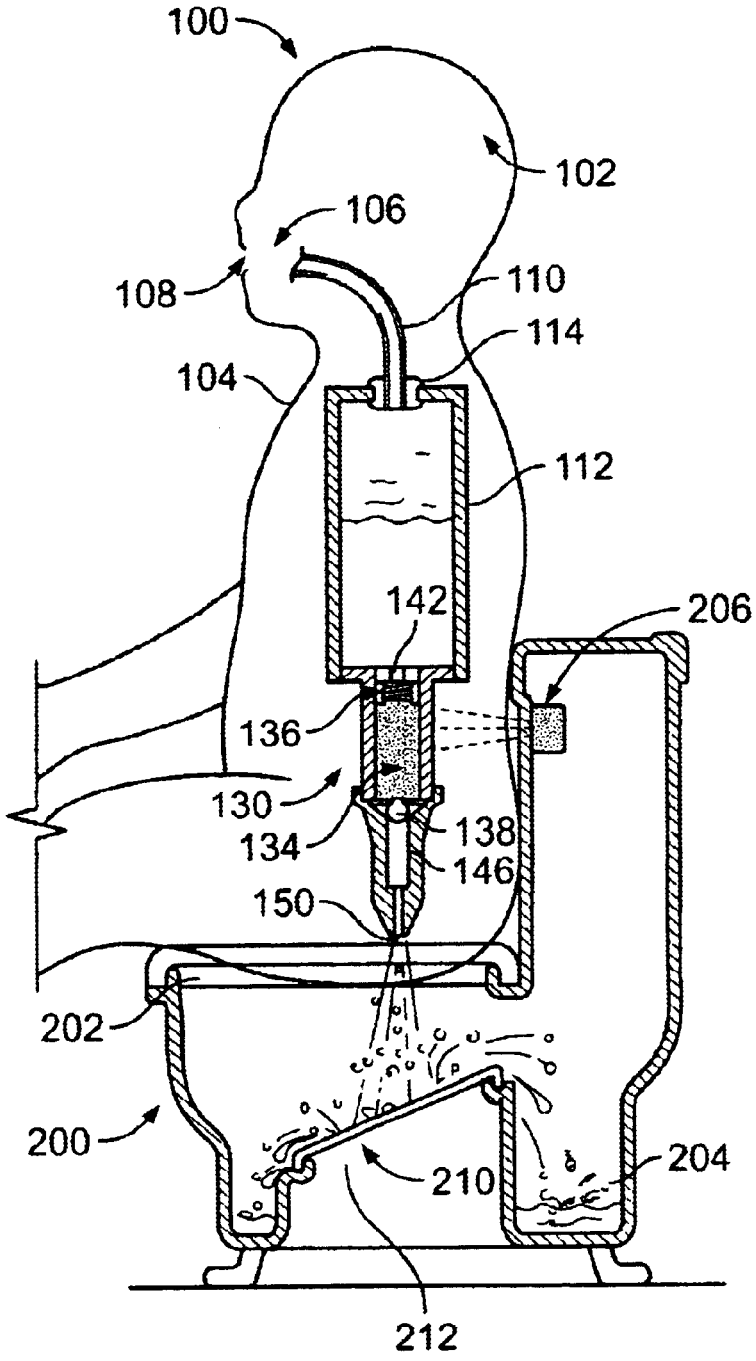
FIG. 3 is a side view of the doll and the toy toilet when the doll is placed on the toy toilet which causes the magnet valve assembly to open allowing the discharge of liquid.

Referring now to FIG. 3, the toy toilet 200 includes a seat 202 for receiving the lower extremity of the doll 100, a basin 204 for the collection of discharged liquid, and a magnet 206 for repelling the magnetic piston 134. As illustrated, when the doll 100 is placed on the toy toilet 200, the magnet 206 includes a magnetic field that repels the magnetic piston 134 such that the magnetic piston moves upwardly compressing the piston return spring 136. As the magnetic piston 134 moves upwardly, the valve ball 138 moves, breaking the seal against the nozzle 146, thus permitting liquid within the reservoir to discharge out of the second orifice 150.

The toy toilet 200 also provides for a more realistic sound effect by including a piece of material 210 stretched over an opening 212 that is positioned directly under the seat 202 (or where the second orifice 150 in the doll 100 would be when the doll 100 is placed on the seat 202). The material is also made of a natural skin or a plastic film that acts similarly to a drum head. When the doll 100 is discharging liquid, the discharged liquid falls onto the stretched material 210 creating a realistic sound effect that the doll 150 is using a toilet.

Figure 4A:
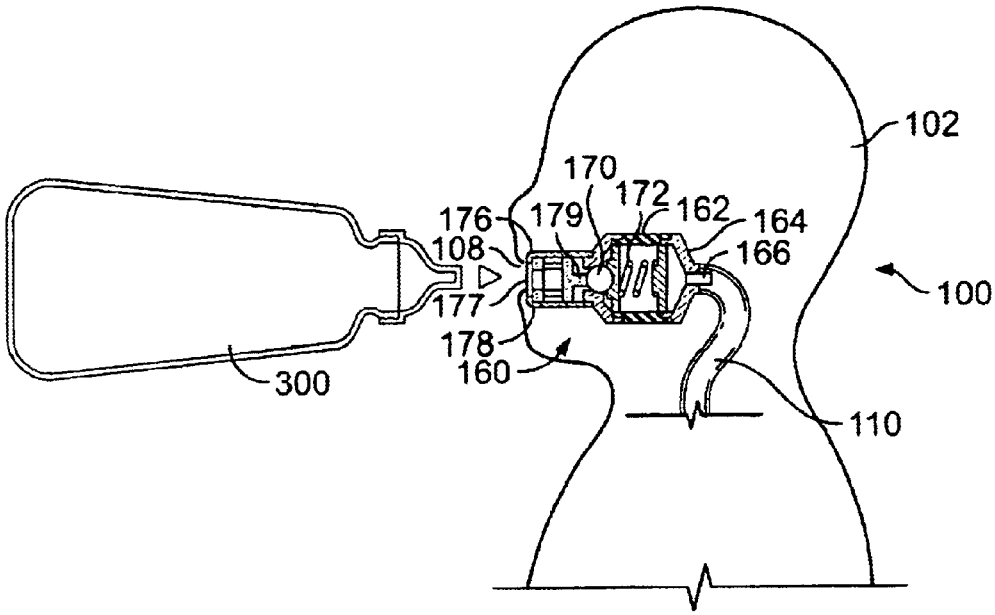
FIG. 4*a* is a side view illustrating a doll with a mouth valve in accordance with another embodiment of the present invention.
Figure 4B:
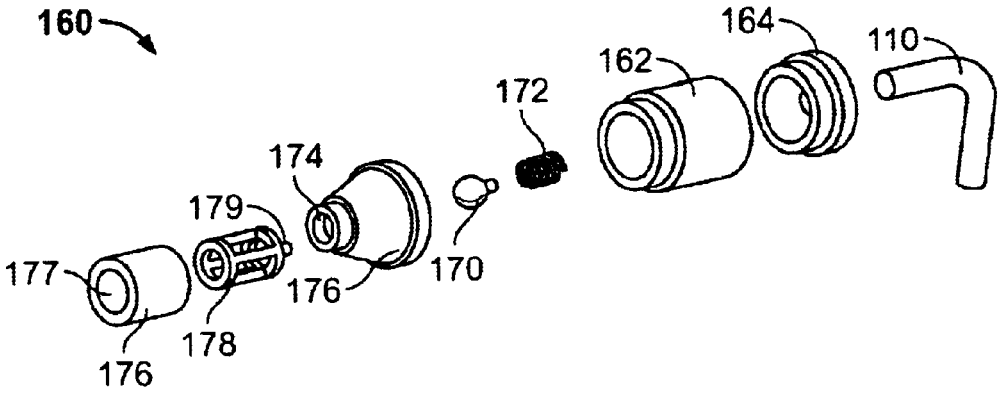
FIG. 4*b* is an exploded view of the mouth valve from FIG. 4*a;*

In another embodiment of the present invention, the doll 100 may include a mouth valve 160 to prevent liquid in the reservoir 112 from exiting the first orifice 106, illustrated in FIGS. 4*a* and 4*b*. The mouth valve 160 only opens when a bottle 300 is pressed into the orifice 106 such that the mouth valve 160 is engaged by the bottle 300 and opened permitting liquid in the bottle 300 to flow into the tube 110. When the bottle 300 is removed the mouth valve 160 closes, thereby preventing the liquid in the reservoir 112 from exiting the doll 100 via the mouth 108. The mouth valve may be defined by any well known one-way valve such as a spring-actuated valve. One such one-way valve is illustrated in FIG. 4*b*, the mouth valve 160 includes a valve body 162 that houses the components of the mouth valve 160. Attached to the rear of the valve body 162 is a rear valve cap 164 that includes a rear spout 166 that receives and attaches to the tube 110. The other end of the valve body 162 is secured to a front valve seat 160. Positioned within the valve body 162 is a ball valve 170 that is biased against an opening 174 defined in the front valve seat 160 by a valve spring 172. The mouth valve 160 further includes a valve cap 176 positioned within the opening 106 of the mouth 108 and includes an actuator pin 178 that engages the ball valve 170, during use. As the bottle 300 is pressed into the mouth 108, the tip 302 of the bottle 300 enters the mouth 108 and passes through an aperture 177 in the valve cap 176. The tip 302 engages the actuator pin 178 and pushes the actuator pin 178 inwardly. The actuator pin 178 includes a pin 179 that is aligned to press the ball valve 170 inwardly against the valve spring 172. Once the ball valve 170 moves liquid within the bottle 300 is able to travel through the mouth valve 160 and into the reservoir 112 which is attached to the tube 110. More importantly, once the bottle 300 is removed the valve spring 172 biases the ball valve 170 against the valve cap 176, preventing any liquid in the tube 110 or reservoir 112 from spilling out of the doll 100.

Figure 5B:
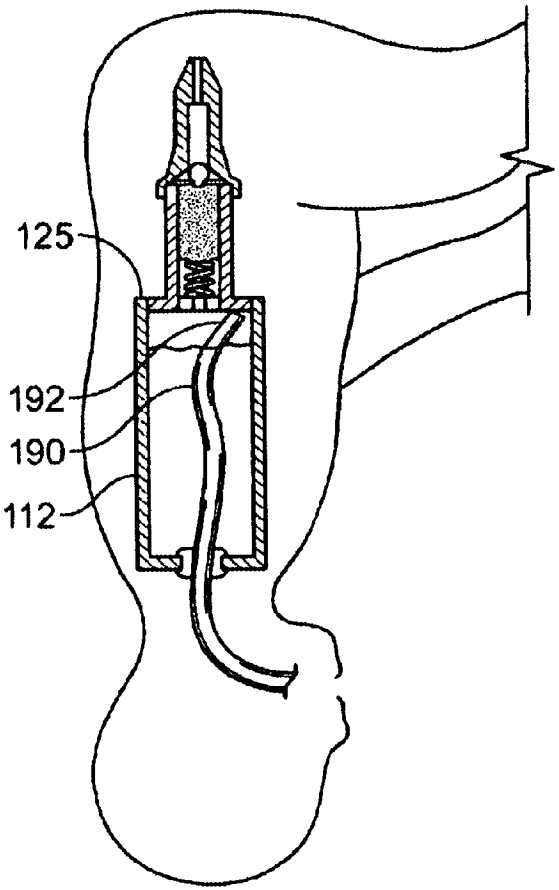
FIG. 5*b* is an upside down view of the doll from FIG. 5*a*.
Figure 5A:
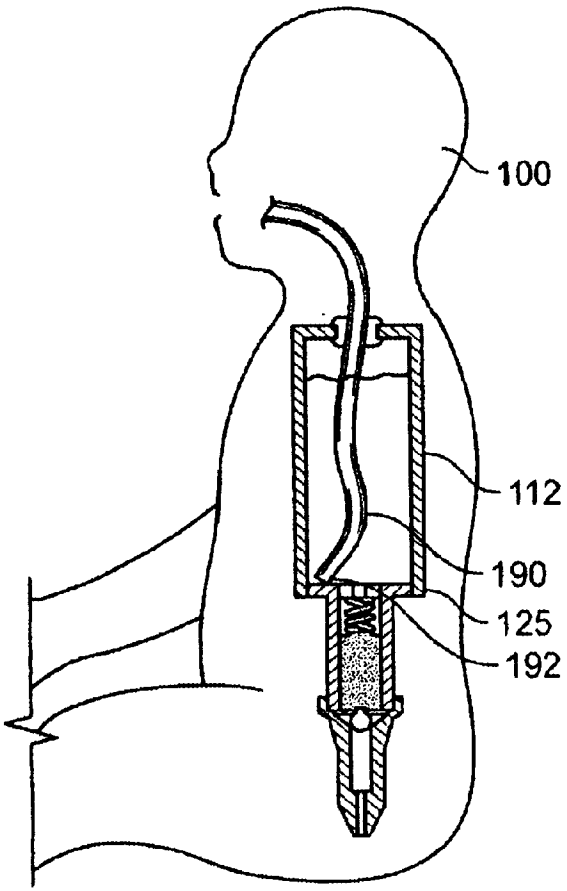
FIG. 5*a* is a side view illustrating another doll with a means to prevent liquid in the reservoir from leaking out of the mouth.

In another embodiment illustrated in FIGS. 5*a* and 5*b*, the doll 100 configured similarly to the doll illustrated in FIGS. 1 through 3, includes a tube 190 that has one end 192 that is opened to the reservoir 112 and positioned in proximity to the bottom portion 125 of the reservoir 112 to allow the liquid to flow directly from the tube 190 into the reservoir 112. When the doll 100 is flipped over to an inverted position or turned to one side such that the legs are positioned higher than the head, the liquid in the reservoir 112 will move away from the bottom portion 125, thus liquid in the reservoir 112 will be unable to travel back through the tube 190 because the liquid will no longer be directly in communication with the end 192 of the tube 190.

From the foregoing and as mentioned above, it will be observed that numerous variations and modifications may be effected without departing from the spirit and scope of the novel concept of the invention. It is to be understood that no limitation with respect to the specific methods and/or apparatus illustrated herein is intended or should be inferred. It is, of course, intended to cover by the appended claims all such modifications as fall within the scope of the claims.

We claim:

1. A doll having a head and a torso, the doll comprising:

an orifice positioned in the head connected to a tube that leads into a reservoir contained within the torso, such that liquid is permitted to flow through the orifice into the reservoir;

a magnetic valve assembly having a hollow valve housing with a top portion secured to a bottom section defined by the reservoir, a central opening in said top portion, and the hollow valve housing has at least one inside wall with a longitudinal groove, a magnetic piston is slidably received within the valve housing, wherein the longitudinal groove permits liquid within the reservoir to travel past the magnetic piston, a valve ball is secured to the magnetic piston, and a spring is positioned within the valve housing biasing the magnetic piston out of the bottom section of the reservoir;

a nozzle having a second orifice and is in communication with the bottom section of the hollow valve housing, the nozzle has an inside wall that creates a fluid tight seal with the valve ball when the magnetic piston is biased by the spring, such that liquid is prevented from exiting the nozzle via the second orifice; and a repelling magnet disposed externally of the doll adapted to exert a repelling magnetic field to the magnetic piston to force the magnetic piston upwardly against the spring such that the fluid fight seal between the valve ball and the nozzle is temporarily broken to permit liquid within the reservoir to travel through the second orifice and discharge from the doll.

2. The doll in claim 1, including in combination a toy toilet provided with a frame, a seat, a basin, and said repelling magnet positioned to exert the repelling magnetic field on the magnetic piston when the doll is placed on the seat, whereby the liquid in the reservoir is discharged and collected in the basin.

3. The doll in claim 2, wherein the toy toilet includes an opening positioned under the seat and a piece of stretched material covering said opening that creates a sound when liquid falls onto said material.

4. A doll having a head and a torso in combination with a toy toilet, the doll comprising:

a reservoir contained within the torso that can be filled with liquid through a mouth defined by the head of the doll, the reservoir is in communication with a nozzle having an orifice which is sealable with a magnetic valve assembly, the magnetic valve assembly having:

a hollow valve housing includes a top portion secured to the bottom section of the reservoir, a central opening in said top portion, and at least one inside wall with a longitudinal groove, a magnetic piston slidably received within the valve housing, wherein the longitudinal groove permits liquid within the reservoir to travel past the magnetic piston, a valve ball secured to the magnetic piston, and a spring positioned within the valve housing and biasing the magnetic piston out of the bottom section of the reservoir such that the valve ball creates a fluid tight seal against the nozzle sealing the orifice, such that liquid is prevented from exiting the nozzle; and the toy toilet comprising:

a repelling magnet to exert a repelling magnetic field to the magnetic piston to force the magnetic piston upwardly against the spring such that the fluid tight seal between the valve ball and the nozzle is temporarily broken to permit liquid within the reservoir to travel through the second orifice and discharge from the doll.

5. The doll and toy toilet of claim 4, wherein the toy toilet includes a frame, a seat, a basin, an opening positioned under the seat and a piece of stretched material covering said opening that creates a sound when liquid falls onto said material, and said repelling magnet positioned to exert the repelling magnetic field on the magnetic piston when the doll is placed on the seat, whereby when the doll is placed on the seat the liquid in the reservoir discharges, falls onto the stretched material, and collected in the basin.

6. The doll and toy toilet of claim 4, wherein the doll includes a valve in the mouth to prevent liquid in the reservoir from exiting the doll through the mouth.

7. A doll having a head and a torso in combination with a toy toilet, the doll comprising a reservoir contained within the torso that can be filled with liquid through a mouth defined by the head of the doll, the reservoir is in communication with a nozzle having an orifice which is sealable with a magnetic valve assembly, the magnetic valve assembly is defined by a hollow valve housing having a top portion with a central opening that is secured to a bottom section defined by the reservoir, the magnetic valve assembly further includes a magnetic piston slidably received within the valve housing, the valve housing also includes an inside wall with a longitudinal groove such that liquid within the reservoir is permitted to travel past the magnetic piston, a valve ball is secured to the magnetic piston, and a spring is positioned within the valve housing that biases the magnetic piston out of the bottom section of the reservoir such that the valve ball creates a fluid tight seal against the nozzle sealing the orifice, such that liquid is prevented from exiting the nozzle; and the toy toilet comprising a frame, a seat, a basin, an opening positioned under the seat and a piece of stretched material covering said opening that creates a sound effect realistic of a person using a toilet when liquid falls onto said material, and a repelling magnet that is capable of exerting a repelling magnetic field onto the magnetic valve assembly forcing the magnetic piston upwardly against the spring breaking the fluid tight seal maintained between the valve ball and the nozzle thus permitting liquid in the reservoir to discharge through the nozzle, whereby when the doll is placed on the seat, liquid within the reservoir is able to travel through the orifice and discharge from the doll onto the stretched material creating simulated sounds.

8. The doll and toy toilet of claim 7, wherein the doll includes a valve in the mouth to prevent liquid in the reservoir from exiting the doll through the mouth.

9. A doll having a head, a torso and a pair of legs, the doll comprising:

an orifice positioned in the head connected to a tube that leads into a reservoir contained within the torso, such that liquid is permitted to flow through the orifice into the reservoir, the tube has one end that is opened to the reservoir and positioned in proximity to a bottom section defined by the reservoir such that when the doll is moved to a position in which liquid in the reservoir is no longer in communication with the end of the tube, liquid in the reservoir is prevented from traveling back through the tube;

a magnetic valve assembly having a hollow valve housing with a top portion secured to the bottom section defined by the reservoir, a central opening in said top portion, and the hollow valve housing has at least one inside wall with a longitudinal groove, a magnetic piston is slidably received within the valve housing, wherein the longitudinal groove permits liquid within the reservoir to travel past the magnetic piston, a valve ball is secured to the magnetic piston, and a spring is positioned within the valve housing biasing the magnetic piston out of the bottom section of the reservoir;

a nozzle having a second orifice and is in communication with the bottom section of the hollow valve housing, the nozzle has an inside wall that creates a fluid tight seal with the valve ball when the magnetic piston is biased by the spring, such that liquid is prevented from exiting the nozzle via the second orifice; and a repelling magnet disposed externally of the doll adapted to exert a repelling magnetic field to the magnetic piston to force the magnetic piston upwardly against the spring such that the fluid tight seal between the valve ball and the nozzle is temporarily broken to permit liquid within the reservoir to travel through the second orifice and discharge from the doll.

10. The doll and toy toilet of claim 9, wherein the doll includes a valve in the mouth to prevent liquid in the reservoir from exiting the doll through the mouth.

11. The doll in claim 10, including in combination a toy toilet provided with a frame, a seat, a basin, and said repelling magnet positioned to exert the repelling magnetic field on the magnetic piston when the doll is placed on the seat, whereby the liquid in the reservoir is discharged and collected in the basin.

12. The doll in claim 11, wherein the toy toilet includes an opening positioned under the seat and a piece of stretched material covering said opening that creates a sound when liquid falls onto said material.

* * * * *